US008671676B2

(12) United States Patent
Pinto

(10) Patent No.: US 8,671,676 B2
(45) Date of Patent: Mar. 18, 2014

(54) MAXIMIZED THERMAL EFFICIENCY ENGINES

(76) Inventor: Adolf Patrick Pinto, Richland, WA (US)

( * ) Notice: Subject to any disclaimer, the term of this patent is extended or adjusted under 35 U.S.C. 154(b) by 434 days.

(21) Appl. No.: 12/884,387

(22) Filed: Sep. 17, 2010

(65) Prior Publication Data

US 2012/0067040 A1 Mar. 22, 2012

(51) Int. Cl.
*F02G 1/043* (2006.01)

(52) U.S. Cl.
USPC ..... 60/517

(58) Field of Classification Search
USPC ..... 60/517, 516, 512, 682, 659, 650, 508
See application file for complete search history.

(56) References Cited

U.S. PATENT DOCUMENTS 2,658,349 A * 11/1953 Keller ..... 60/682
5,016,441 A * 5/1991 Pinto ..... 60/516
6,799,425 B2 * 10/2004 Emmel et al. ..... 60/659
7,143,587 B2 * 12/2006 Acharya et al. ..... 62/6
2004/0040297 A1 * 3/2004 Pels ..... 60/516
2008/0016907 A1 * 1/2008 Barclay et al. ..... 62/612

* cited by examiner

*Primary Examiner* — Thomas Denion
*Assistant Examiner* — Shafiq Mian

(57) ABSTRACT

This disclosure provides a method for efficiently converting heat energy to readily usable energy with maximized thermal efficiency. Maximized thermal efficiency is obtained by the use of heat regeneration and working gas processing steps that optimize the heat regeneration, so that any heat that is supplied to the working gas from the external heat source is supplied at the maximum temperature, and any heat that is rejected from the working gas to an external heat sinks is rejected at the minimum temperature, given the constraints of the the heat source and heat sink temperatures. Two basic designs of engines are proposed. One of the basic designs uses pairs of heat regenerators, and would be suitable for stationary power generation applications. The other basic design uses single heat regenerators and would be suited for motive power applications. Both piston cylinder and turbocompressor driven engine applications can be used in each of the two basic designs of engines.

6 Claims, 7 Drawing Sheets

MAXIMIZED THERMAL EFFICIENCY ENGINES

FIELD OF THE DISCLOSURE

This disclosure relates to hot gas engines, particularly to piston cylinder engines and gas turbine engines capable of having improved thermal efficiency, and more particularly to hot gas engines of the Stirling type.

BACKGROUND OF THE DISCLOSURE

Hot gas engines of the Stirling type have been primarily external combustion engines employing pistons and cylinders. State of the art hot gas engines with pistons that are configured to turn drive shafts are designed with hot and cold cylinders, and a heat regenerator connected between the hot and cold cylinders. Separate hot and cold cylinders increase cost. Extensive developmental work has been carried out on hot gas engines because of their promise of high thermal efficiency. However, the hot gas engines developed so far have not succeeded in achieving the high thermal efficiency that is potentially possible. The inability to achieve high thermal efficiency is primarily because existing state of the art hot gas engines do not have their heat regenerators and their working gas processing steps designed for optimum heat regeneration. U.S. Pat. No. 4,455,825 pointed out that the working gas processing steps, and consequently the heat regeneration were not optimum. The heat regeneration was not optimum because working gas flowed between the hot and cold cylinders during the expansion and compression steps. Working gas that is present in, or that flows into the cold cylinder during the expansion step, and the working gas that is present in or flows into the hot cylinder during the compression step, produce negative work loops, and negatively impact the thermal efficiency. The working gas crossover issues were solved in U.S. Pat. Nos. 4,455,825 and 4,676,067. However, the engines in those patents did not address the role and design of the heat regenerator, and the engines in those patents continued to use separate hot and cold cylinders. The hot gas engines proposed in this disclosure are designed around the heat regenerator, and do not use separate hot and cold cylinders. In the engines proposed in this disclosure, the cold cylinder used in prior hot gas engines is replaced with a heat rejection means or cooler, and the hot cylinder is replaced with generalized pressure variation means.

SUMMARY OF THE DISCLOSURE

A hot gas engine model comprising a linear heat regenerator, with a heat rejection means or a cooler at one end, and a heat addition and pressure variation means at the opposite end, is proposed. The end of the heat regenerator where the cooling means is located is referred to as the first end or the cold end, and the end of the heat regenerator connected to the heat addition and pressure variation means is referred to as the second end or the hot end. The working gas processing steps in each heat regenerator consist of alternately expanding and compressing the working gas. During each expansion step, the working gas expands, its pressure decreases, its volume increases, and every elemental quantity of working gas flows from cooler to hotter regions. Thus, during the expansion step, the dual effects of the working gas is being continuously moved into a hotter regions and the tendency to decrease in temperature due to the expansion, result in an increased potential for the transfer of heat from the heat regenerator material to the expanding working gas in the heat regenerator.

The heat addition means adds heat to the working gas that is expanding and flowing out of the second end of the heat regenerator. The expanding working gas interacts with and transfers to the pressure variation means, readily usable energy that is generated by the expansion of the working gas. Each expansion step is followed by a compression step, where the pressure variation means uses a fraction of the readily usable energy generated in the prior expansion step, to cause working gas to flow into the second end of the heat regenerator to compress the working gas already present in the heat regenerator and its heat rejection means. During each compression step, the working gas compresses, its pressure increases, its volume decreases, and every elemental quantity of working gas flows from cooler to hotter regions. Thus, during the compression step, the dual effects of the working gas being continuously moved into cooler regions and the tendency to increase in temperature due to the compression, result in an increased potential for the transfer of heat from the compressing working gas to the heat regenerator material. During the compression step, heat is rejected from the compressing working gas in the heat rejection means to the heat sink.

Two basic types of engines are possible based on the proposed engine model. The first basic type of engine consists of paired heat regenerators positioned on either side of the heat addition and pressure variation means, and are part of engines that operate 180° out of phase with each other. In this first basic design type, the heat regenerators may be considered as large pressure vessels, where the pressure in each heat regenerator varies cyclically, and inversely with respect to the pressure in its paired heat regenerator, from a maximum pressure $P_{MAX}$ to a minimum pressure $P_{MIN}$, as the working gas flows back and forth from one heat regenerator to the other through the heat addition and pressure variation means. Therefore, in the first basic design type of engine, the heat regenerators of each pair share the heat addition means, the pressure variation means, and portions of the working gas. The second basic design type of engine consists of a single heat regenerator. During each expansion step in engines of the second basic design type, the expanding working gas flows out of the second end of the heat regenerator, has heat added to it by the heat addition means, and interacts with and transfers to the pressure variation means the readily usable energy generated by the expansion of the working gas. The pressure variation means then utilizes a portion of the readily usable energy generated in the previous expansion step to push the working gas back into the heat regenerator through its second end to cause each subsequent compression step to occur.

Hot gas engines have traditionally been of the external combustion closed loop kind. Three engines utilizing external combustion heat exchangers with closed cycle operation have been presented (FIGS. 1, 2, and 4). This invention disclosure demonstrates how hot gas engines can be used with internal combustion heat addition means. Two engines with internal combustion heat addition means have been proposed, one for each of the two basic design types (FIGS. 3 and 5). The internal combustion heat addition is accomplished by hot products of combustion added to the expanding working gas exiting the second end of a heat regenerator. The hot products of combustion mix with the expanding working gas, thereby adding heat to the expanding working gas, and becoming part of the working gas. An approximately equal quantity of working gas, is then bled from the heat rejection means of the paired heat regenerator towards the end of the compression step, in the case of engines of the first basic design type. In the case of engines of the second basic design type, the additional working gas created by the addition of the hot products of combustion, will be bled from the heat rejection means towards the end of the succeeding compression step. In both the first and second basic design types of engines, where internal combustion heat addition means are utilized, an energy recovery device is provided to recover the energy present in the bled working gas. The recovered energy can be used to compress fresh atmospheric air for use as combustion air in the fuel burner that produces the hot products of combustion.

BRIEF DESCRIPTION OF THE DRAWINGS

A more detailed description of the disclosure follows below with reference to the accompanying drawings, in which.

DETAILED DESCRIPTION OF THE DISCLOSURE

Figure 1:
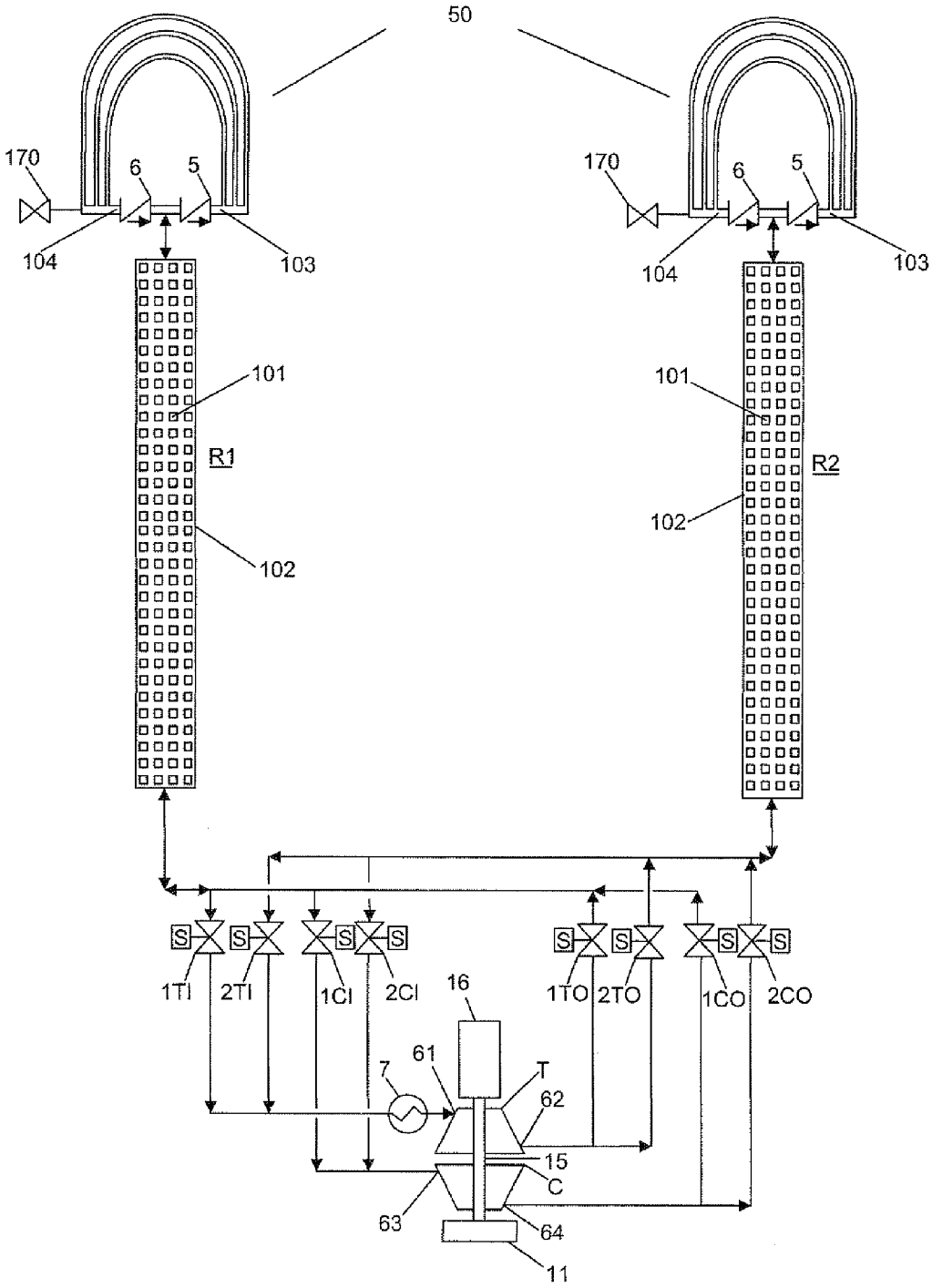
FIG. 1 shows a two impeller turbocompressor driven paired heat regenerator engine according to the disclosure.
Figure 2:
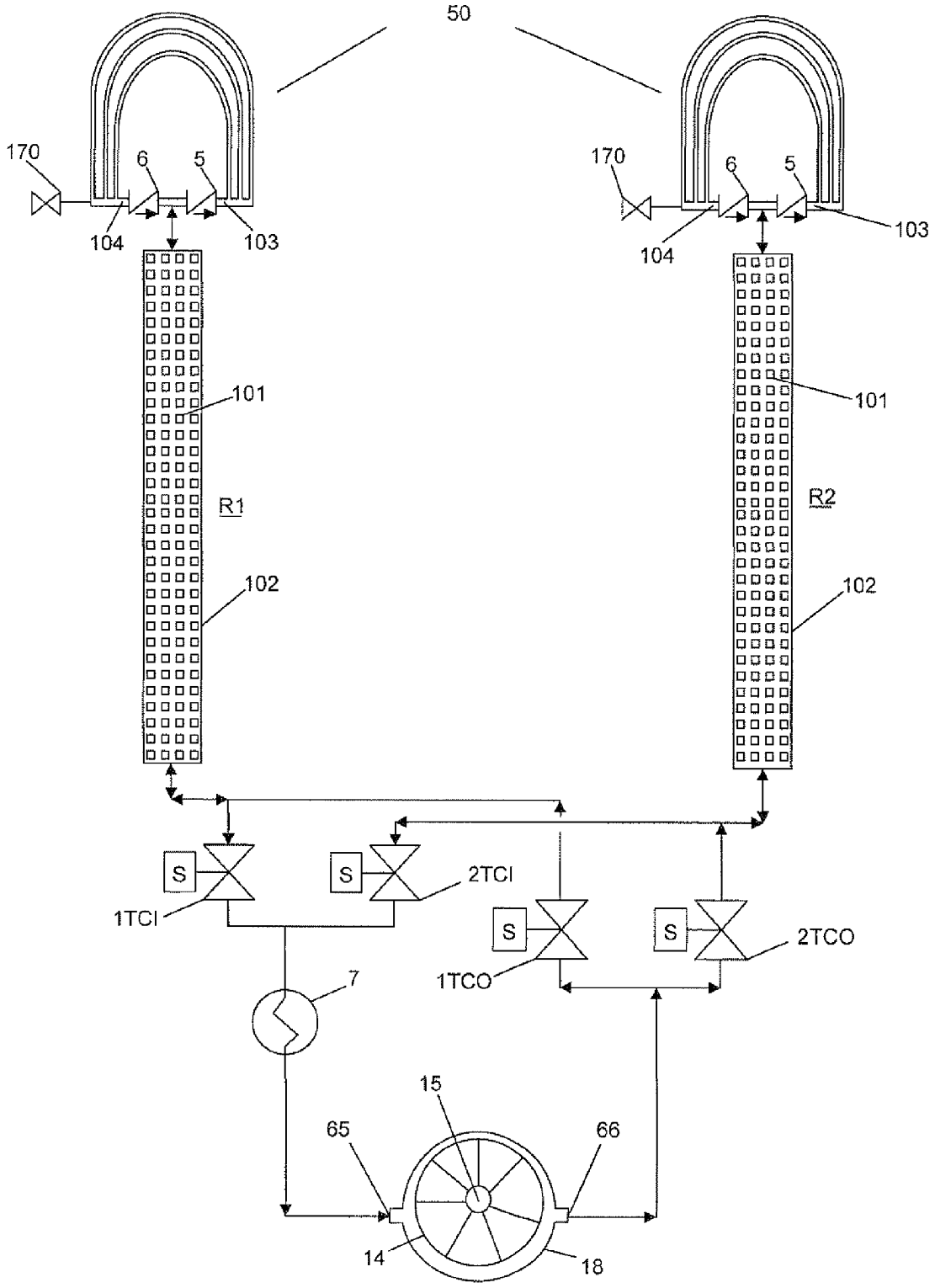
FIG. 2 shows a single impeller turbocompressor driven paired heat regenerator engine according to the disclosure.
Figure 3:
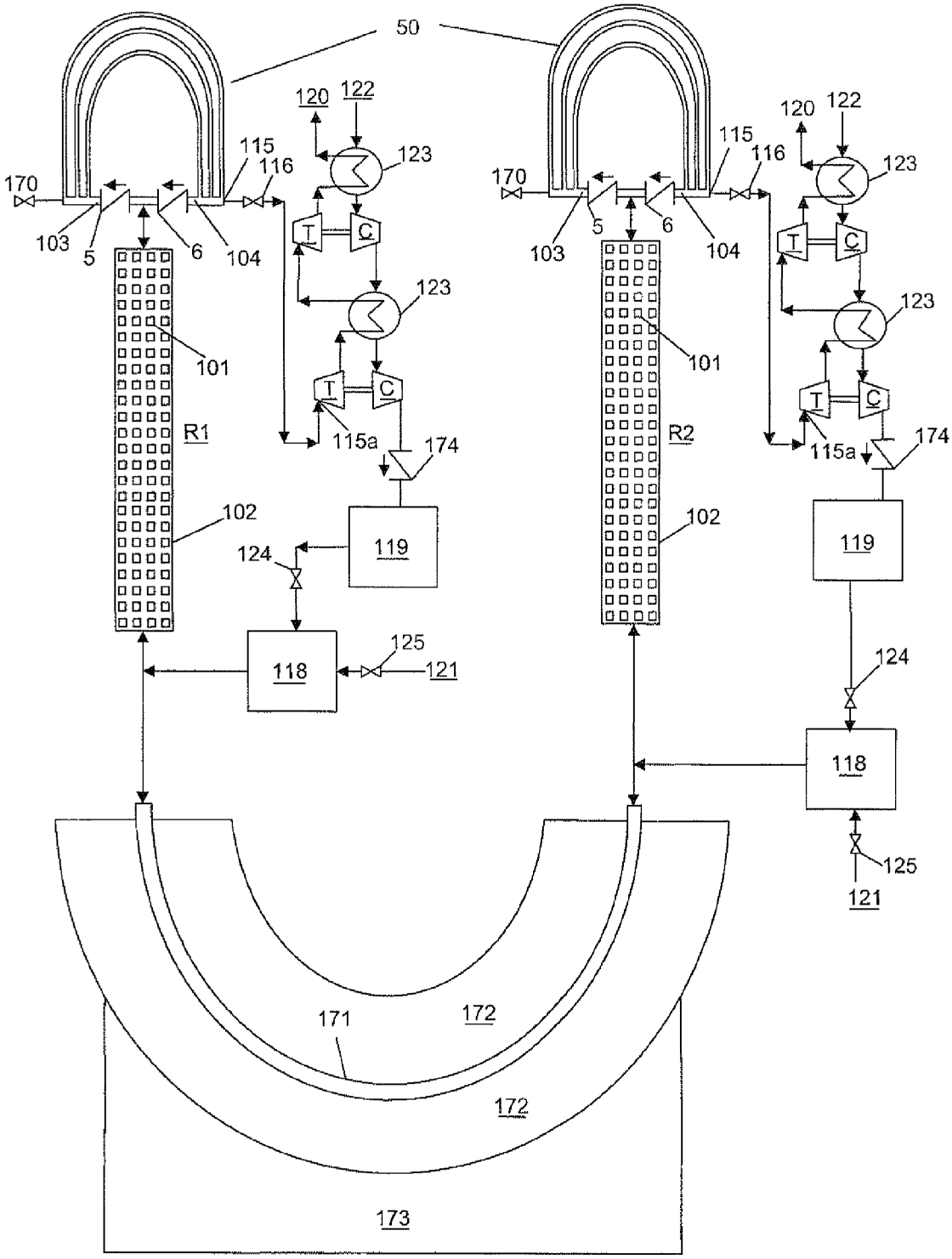
FIG. 3 shows a magnetohydrodynamic driven paired heat regenerator engine according to the disclosure.
Figure 4:
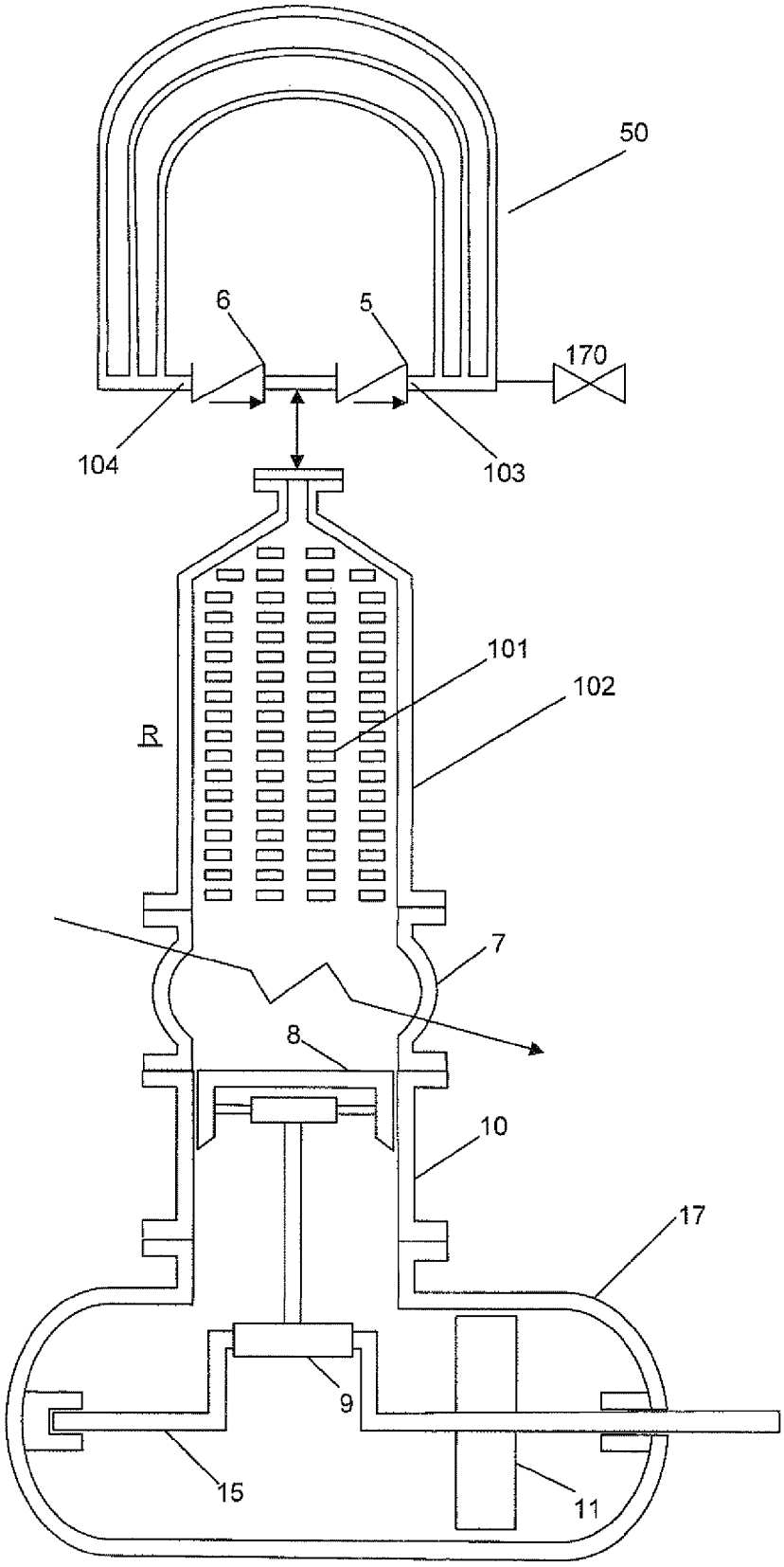
FIG. 4 shows a single heat regenerator piston-cylinder driven engine according to the disclosure.
Figure 5:
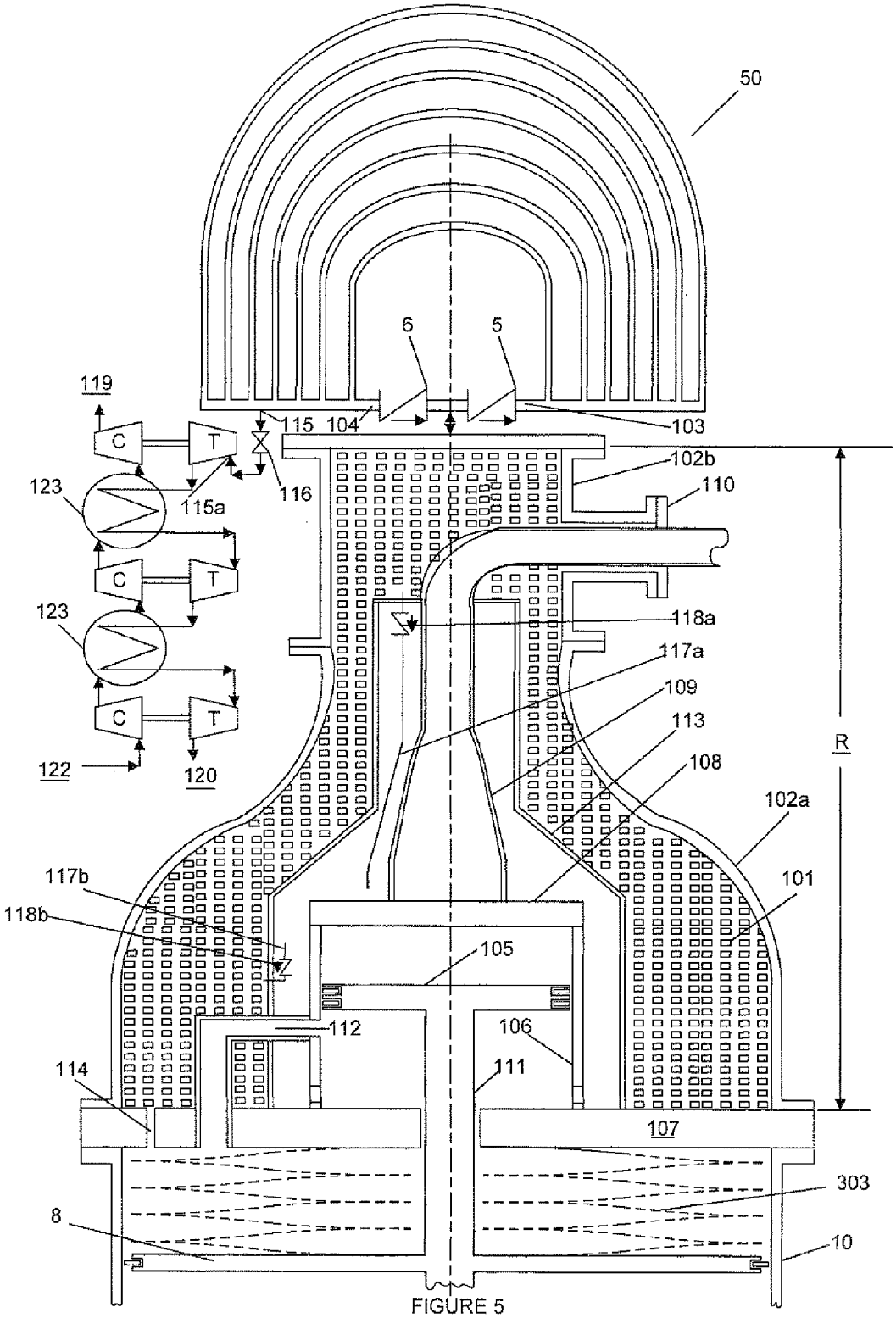
FIG. 5 shows a fuel fired single heat regenerator piston cylinder driven engine according to the disclosure.

First heat regenerator (R1) and second heat regenerator (R2) in FIGS. 1, 2, and 3, and heat regenerator (R) in FIGS. 4 and 5 comprise thermal capacity possessing, finely divided, heat regenerator material (101), enclosed in a pressure confining, heat insulating, minimized heat conducting boundary (102) having a first end and a second end. Fluid seal connected to the first end of each heat regenerator (R1, R2, and R) is heat rejection means (50). The heat rejection means (50) is provided with inlet and outlet ports (103) and (104) respectively. Two one way check valves (5) and (6) are provided in the flow paths from the heat regenerator (R1, R2 and R) to the heat rejection means (50). Check valve (5) ensures that when the working gas flows from the heat regenerator to the heat rejection means it will only enter through the inlet port (103), and check valve (6) ensures that when the working gas flows from the heat rejection means to the heat regenerator it will only flow through the outlet port (104). Heat rejection means (50) is provided with heat transfer surface area to facilitate the transfer of heat from the working gas in the heat rejection means to a heat sink (not shown). Fluid seal connected to heat rejection means (50) is provided a bleed and fill valve (170) for use during maintenance and startup. Bleed and fill valve (170) is not required and is not shown in FIG. 5.

The heat regenerator is designed as a linear component with the linear axis (which corresponds to the direction of flow of the working gas), extending from the mid point of one of the ends of the regenerator to the other. The heat regenerator material (101) is finely divided for the purpose of permitting the flow of working gas through the heat regenerator with minimized pressure drop, while at the same time maximizing the heat transfer surface area for heat transfer between the heat regenerator material (101) and the working gas that surrounds it. The minimized heat conduction boundary (102) of the heat regenerators and the finely dividing of the heat regenerator material (101) serve to minimize the conduction and degradation of heat along the length of the heat regenerator. Some examples of the heat regenerator material (101) include sheets of wide weave wire mesh fabricated from thin or small diameter wire. The sheets of wire mesh would be cut to match the working gas flow cross-section of the heat regenerator, and would be packed loosely inside the heat regenerator housing with the wire mesh sheets perpendicular to the direction of working gas flow. The heat addition means (7) in the FIGS. 1, 2, and 4 engines comprises an external combustion heater or heat exchanger. In the FIG. 3 and FIG. 5 engines, the heat addition is accomplished by adding hot products of combustion into the expanding working gas exiting the second end of a heat regenerator during an expansion step. The working gas in FIGS. 1, 2, and 4 engines can theoretically be any suitable gas, but is envisioned to be dry compressed air. The working gas in the FIGS. 3 and 5 engines is exhaust gas from a fuel fired burner. The working gas in the FIG. 3 engine is the products of combustion of a fossil fuel (coal or oil) burner to which a small amount of seed material is added to give the products of combustion electrical properties. The working gas in the FIG. 5 engine is the products of combustion of an internal combustion engine. The internal combustion engine serves as the burner in the FIG. 5 engine.

In FIG. 1, the pressure variation means comprise two separate matched impellers (T) and (C) and a set of valve controller operated valves as described below. impeller (T) serves as a turbine and impeller (C) serves as a compressor. Turbine (T) is provided with inlet and outlet ports (61) and (62) respectively. Compressor (C) is provided with inlet and outlet ports (63) and (64) respectively. Turbine (T) and compressor (C) are both shown on a common drive shaft (15). Drive shaft (15) is equipped with flywheel (11) for smoothing rotation, and generator (16) for generating electrical energy from the rotation of shaft (15). Heater (7) is provided upstream of turbine inlet (61), with heater (7) outlet fluid seal connected to turbine inlet (61). Heater (7) inlet is fluid seal connected through valves 1TI and 2TI to the second ends of heat regenerators R1 and R2 respectively. Turbine outlet (62) is fuid seal connected through valves 1TO and 2TO to the second ends of heat regenerators R1 and R2 respectively. Compressor inlet (63) is fluid seal connected through valves 1CI and 2CI to the second ends of heat regenerators R1 and R2 respectively. Compressor outlet (64) is fluid seal connected through valves 1CO and 2CO to the second ends of heat regenerators R1 and R2 respectively. Valves 1TI, 2TI, 1TO, 2TO, 1CI, 2CI, 1CO and 2CO are controlled by a valve controller (not shown). The valve controller is designed to operate the above valves as follows: (a) close valves 2CI and 1CO and open valves 1TI and 2TO when the increasing working gas pressure in R1 and the decreasing working gas pressure in R2 reach their maximum and minimum values respectively; (b) close valves 1TI and 2TO and open valves 1CI and 2CO when the decreasing working gas pressure in R1 and the increasing working gas pressure in R2 equalize; (c) close valves 1CI and 2CO and open valves 2TI and 1TO when the increasing working gas pressure in R2 and the decreasing working gas pressure in R1 reach their maximum and minimum values respectively, (d) close valves 2TI and 1TO and open valves 2CI and 1CO when the decreasing working gas pressure in R2 and increasing working gas pressure in R1 equalize, during each cycle. Hence, in FIG. 1 the pressure variation means comprise turbine (T), compressor (C), valves and valve controller with valve timing as described, and the second end of first heat regenerator (R1) and the second end of second heat regenerator (R2) are fluid seal connected to each other through the pressure variation and heat addition means.

In FIG. 2, the pressure variation means comprise a single impeller (14) and a set of valve operator controlled valves described below. Impeller (14) serves as a turbine when the pressure upstream of impeller (14) is greater than the pressure downstream, and serves as a compressor when the pressure upstream of impeller (14) is lower than the pressure downstream. Impeller (14) is located on drive shaft (15) which is equipped with a flywheel (not shown) for smoothing rotation, and generator (not shown) for generating electrical energy from the rotation of shaft (15). Impeller (14) is housed in impeller housing (18) shown in cutaway view. Impeller housing (18) which fluid seals the working gas around impeller (14) is equipped with inlet and outlet ports (65) and (66) respectively. Heat addition means comprising heater (7) is provided upstream of impeller housing inlet (65), with the heater (7) outlet fluid seal connected to impeller housing inlet (65). Heater (7) inlet is fluid seal connected through valves 1TCI and 2TCI to the second ends of heat regenerators R1 and R2 respectively. Impeller housing outlet (66) is fluid seal connected through valves 1TCO and 2TCO to the second ends of heat regenerators R1 and R2 respectively. A valve controller (not shown) is designed to: (a) close valves 2TCI and 1TCO and open valves 1TCI and 2TCO when the increasing working gas pressure in R1 and the decreasing working gas pressure in R2 reach their maximum and minimum values respectively, and (b) close valves 1TCI and 2TCO and open valves 2TCI and 1TCO when the decreasing working gas pressure in R1 and the increasing working gas pressure in R2 reach their minimum and maximum values respectively. Hence, in FIG. 2, the pressure variation means comprise turbocompressor impeller (14), valves and valve controller with valve timing as described, and that the second end of first heat regenerator (R1) and the second end of second heat regenerator (R2) are fluid seal connected to each other through the pressure variation and heat addition means.

In FIG. 3, the heat addition means comprise fossil fuel burner (118) designed to add heat by way of adding hot products of combustion to the working gas as it expands and flows out of the second end of the sending heat regenerator. The products of combustion then become part of the working gas, resulting in a situation of having excess working gas. This situation has to be remedied by bleeding an equal quantity (when averaged over successive cycles) of working gas through an additional port in the heat rejection means as explained later. The pressure variation means comprise a magnetohydrodynamic channel (171) along with the electrical circuitry (not shown) represented in arc shaped box (172) which surrounds the magnetohydrodynamic channel (171). The electrical circuitry (172) is designed to generate electrical energy (readily usable energy) from the interaction of the flowing working gas and the magnetohydrodynamic channel (171) in which the working gas is flowing, and also to cause the flow of the working gas in the magnetohydrodynamic channel (171) to occur by using a portion of the electrical energy previously generated. Circuitry (173) is designed to modify the electrical energy produced in electrical circuitry (172) for transmission to the power grid and also to supply electrical energy back to electrical circuitry (172) to facilitate the continued flow of the working gas through channel (171). The heat rejection means (50) in FIG. 3 are similar to the heat rejection means of the heat regenerators of FIGS. 1 and 2 except that the heat rejection means (50) in FIG. 3 are each provided with a second outlet port (115), which is fluid seal connected to the inlet (115*a*) of the first stage of a multistage energy recovery device through heat regenerator pressure controlled valve (116) designed to open and bleed excess working gas when the heat regenerator it is coonected to is at the tail end of its compression step. The energy recovery device shown in FIG. 3 is a multistage turbo-compressor system. Instead of providing a heat regenerator pressure controlled valve (116), the pressure drop of the bled working gas flow through the turbines of the multistage turbo-compressors could be selected to match the desired bleed rate at the design bleed pressure in the heat regenerator. If the matched pressure drop turbine option is selected instead of providing regenerator pressure controlled valve (116), the flow of bled excess working gas will predominantly occur towards the end of the compression step in the applicable heat regenerator, when the pressure in the heat regenerator and its heat rejection means from where the excess working gas is bled, is highest. Since the excess working gas is bled at pressure, there will be a significant amount of energy present in the bled working gas. The energy captured from the bled working gas by the turbines (T) is utilized by compressors (C) to compress fresh oxygen bearing atmospheric air (122). The bled working gas after the energy present in it has been recovered is discharged to the atmosphere (120). Intercoolers (123) are used to minimize the compression work in energy recovery device compressors (C). The fresh compressed air produced is stored in compressed air storage (119). Valves 124 and 125, designed to operate based on signals from heat regenerator flow instrumentation (not shown), will be used to feed compressed air from compressed air storage (119) and fuel from fuel storage (121) respectively, to fuel burner (118). Valves 124 and 125 are opened when working gas is expanding and flowing out of the second end of the heat regenerator which they serve. The hot products of combustion will thus be mixed with the expanding working gas exiting the second end of the heat regenerator, prior to the working gas entering the magnetohydrodynamic channel (171). The turbocompressor system shown in FIG. 3 is a two stage cocurrent flow system and is symbolic of a general energy recovery system. The specific system provided, including whether a condensed water removal system is required between turbocompressor stages, depends on the specific application, especially the fossil fuel used and the degree of supercharging.

FIG. 4 shows a single heat regenerator engine comprising heat regenerator (R) with finely divided, heat capacity possessing, heat regenerator material (101). The heat rejection means (50) is provided fluid seal connected to the first end of heat regenerator (R). Heat addition means (7) comprises an external combustion heater or heat exchanger. The pressure variation means in FIG. 4 engine comprise a piston (8) reciprocating in a cylinder (10). Cylinder (10) is fluid seal connected to the second end of heat regenerator (R) with the heat addition means interposed and fluid sealed inbetween the second end of heat regenerator (R) and cylinder (10). The heat rejection means (50) of FIG. 4 is similar to the heat rejection means of the heat regenerators of FIGS. 1 and 2 and is provided with the fill and bleed valve (170). Piston (8) is installed on crank (9) on crank shaft (15) located in crank case (17). Flywheel (11) is provided on crankshaft (15) to smooth rotation. An electrical generator (not shown) could be located inside crank case (17) for a hermetically sealed system. Alternatively, crank shaft (15) can be passed to the outside of crank case (17) through a pressure enclosing seal to serve as the power take-off.

FIG. 5 shows a single heat regenerator system comprising a heat regenerator (R) with finely divided heat regenerator material (101). Heat rejection means (50) is provided at the first end of heat regenerator (R). Fluid seal connected to the second end of the heat regenerator (R) is the pressure variation means comprising a pressure variation piston (8) reciprocating in cylinder(10). Fluid sealed to the top of cylinder (10) at its outer circumferential edge is structural plate (107) as shown. Supported on the top of structural plate (107) and fluid sealed to it at the outer circumferential edge is bell reducer shaped member (102*a*) which forms the outer pressure enclosing boundary of heat regenerator (R) for most of its length. Heat regenerator (R) except for a small section at the upper end has an annular cross-section along its tapering length, bounded by member (102*a*) at the outer edge, and member (113) at the inner edge of the annulus. Member (113) is shaped similar to heat regenerator outer shell (102*a*) but smaller in diameter as shown in FIG. 5. Member (113) encloses and provides a zone for the location of an Internal combustion engine. Supported on structural plate (107) is cylinder (106) of a two stroke internal combustion engine. Cylinder (106) is provided with exhaust port(s) (112). Exhaust port(s) (112) fluid seal penetrate member (113) and structural plate (107) to discharge the exhaust gas from the internal combustion engine into the region below structural plate (107). The exhaust gas is thus discharged into the expanding working gas exiting the second end of heat regenerator R, as the pressure variation piston is moving from its top dead center (TDC) position to its bottom dead center (BDC) position. The internal combustion engine thus serves as the heat addition means for the FIG. 5 engine. Internal combustion engine cylinder (106) is provided with head plate (108) which fluid seals the upper end of internal combustion engine cylinder (106). The ignition means (not shown), fuel/air inlet port (not shown), and combustion chamber (not shown) for the two stroke internal combustion engine are located on or in head plate (8). Attached to, and fluid seal connected to lower section (102*a*) of heat regenerator (R) at its upper end is upper section (102*b*) of heat regenerator (R). Upper section (102*b*) is in the shape of a pipe tee. Member (109) whose lower section is similarly shaped as member (113) but of smaller diameter encloses the wiring to the internal combustion engine ignition means and fuel/air inlet piping (not shown). Member (109) is fluid sealed at its lower end to internal combustion engine head plate (108). At its upper end, member (109) passes through a fluid sealed opening in the top of member (113) as shown, bends and exits regenerator (R) through the tee portion of the upper heat regenerator section (102*b*). Circular plate (110) fluid seals the opening in the tee portion of upper heat regenerator section (102*b*) while permitting member (109) to pass to the outside of heat regenerator (R), as shown. Two stroke internal combustion engine piston (105) reciprocates in two stroke engine cylinder (106). Piston (105) is rigidly connected by connecting member (111) to pressure variation piston (8) as shown. Connecting member (111) passes through an opening in structural plate (107). The opening in structural plate (107) is just large enough for connecting member (111) to pass through noncontactingly. Finely divided heat regenerator material (101) is positioned in heat regenerator (R) between the outer shell made up of members (102*a*) and (102*b*), and bell jar shaped component (113) which, as already mentioned, forms the inner annular pressure enclosing boundary of heat regenerator (R). Numerous approximately equally spaced holes (114) are provided in structural plate (107) at appropriate locations, to permit the working gas in the zone occupied by heat regenerator (R) to pass freely through structural plate (107) into the volume swept by pressure variation piston (8). Several tubes (117*a*) each provided with a one-way flow check valve (118*a*) are provided fluid seal penetrating the top of bell jar shaped housing (113) to bring relatively cool air from the first end of heat regenerator (R) to cool the two stroke engine components. The cooling air is discharged back into heat regenerator (R) at a higher temperature location through several tubes (117*b*) each provided with a one-way flow check valve (118*b*). In the volume swept by the pressure variation piston (8) are provided numerous screens (303). Each screen is fabricated from coarse weave thin wire, similar to that used in the heat regenerator. Each screen is annular in shape with an outer diameter which matches the diameter of pressure variation piston (8) and an inner diameter that permits it to be installed around member (111). The screen next to the pressure variation piston is connected to the pressure variation piston and the screen next to structural plate (107) is connected to structural plate (107). Each screen inbetween is connected to the adjacent screen on either side of it in such a way that with the pressure variation piston (8) at its top dead center (TDC) position, the screens are in a collapsed or compacted form, with the void volume between pressure variation piston (8) and structural plate (107) that can be occupied by the working gas minimized, and with the pressure variation piston at its bottom dead center (BDC) position, the screens are spread out approximately equidistant from each other similar to an accordion. The accordioning screens are impregnated with a catalyst that can catalytically convert the unburned hydrocarbons in the exhaust gas from the two stroke engine, and also another catalyst capable of catalytically reducing nitrogen oxide gases to nitrogen. In order to take care of some unburned hydrocarbons and oxides of nitrogen that may still be present in the exhaust gas from the two stroke engine, quantities of these catalysts are also provided impregnated in the heat regenerator material (101) that is located adjacent to the second end of heat regenerator (R). In FIG. 5, the description for the heat rejection means (50) is similar to that for FIG. 3 in that the heat rejection means in FIG. 5 is provided with a second outlet port (115), which fluid seal connects heat rejection means (50) through piston position controlled valve (116) to the inlet (115*a*) of a multistage turbocompressor system with intercoolers (123). Piston position controlled valve (116) is designed to open for a brief fraction of the time each cycle while the pressure variation piston (8) is travelling from its bottom dead center (BDC) position to its top dead center position. The exact point in the compression cycle and the duration of how long piston position controlled valve (116) remains open would depend on the specific design of the engine. Also, the number of turbocompressor stages in the energy recovery device would depend upon the degree of supercharging employed in the FIG. 5 engine. The function of turbines (T) of the energy recovery turbocompressor is to expand the excess working gas in stages from the supercharged pressure at which the FIG. 5 hot gas engine operates to atmospheric pressure, while their matched compressors (C) compress fresh atmospheric air (122) for supplying compressed air (119) as combustion air to the two stroke internal combustion engine. The components and flow path required to feed the compressed atmospheric air (119) as combustion air to the two stroke internal combustion engine are not shown. The intercoolers (IC) exchange heat between the hot compressed fresh atmospheric air and the bled excess working gas that has been cooled by expansion. Condensed water removal points (not shown) will be needed for the expanding and cooling excess working gas in between the expansion stages. As mentioned in the case of the FIG. 3 engine, any one of several energy recovery devices can be used. The energy recovery mechanism shown in FIG. 5 happens to be a turbocompressor system.

Figure 6:
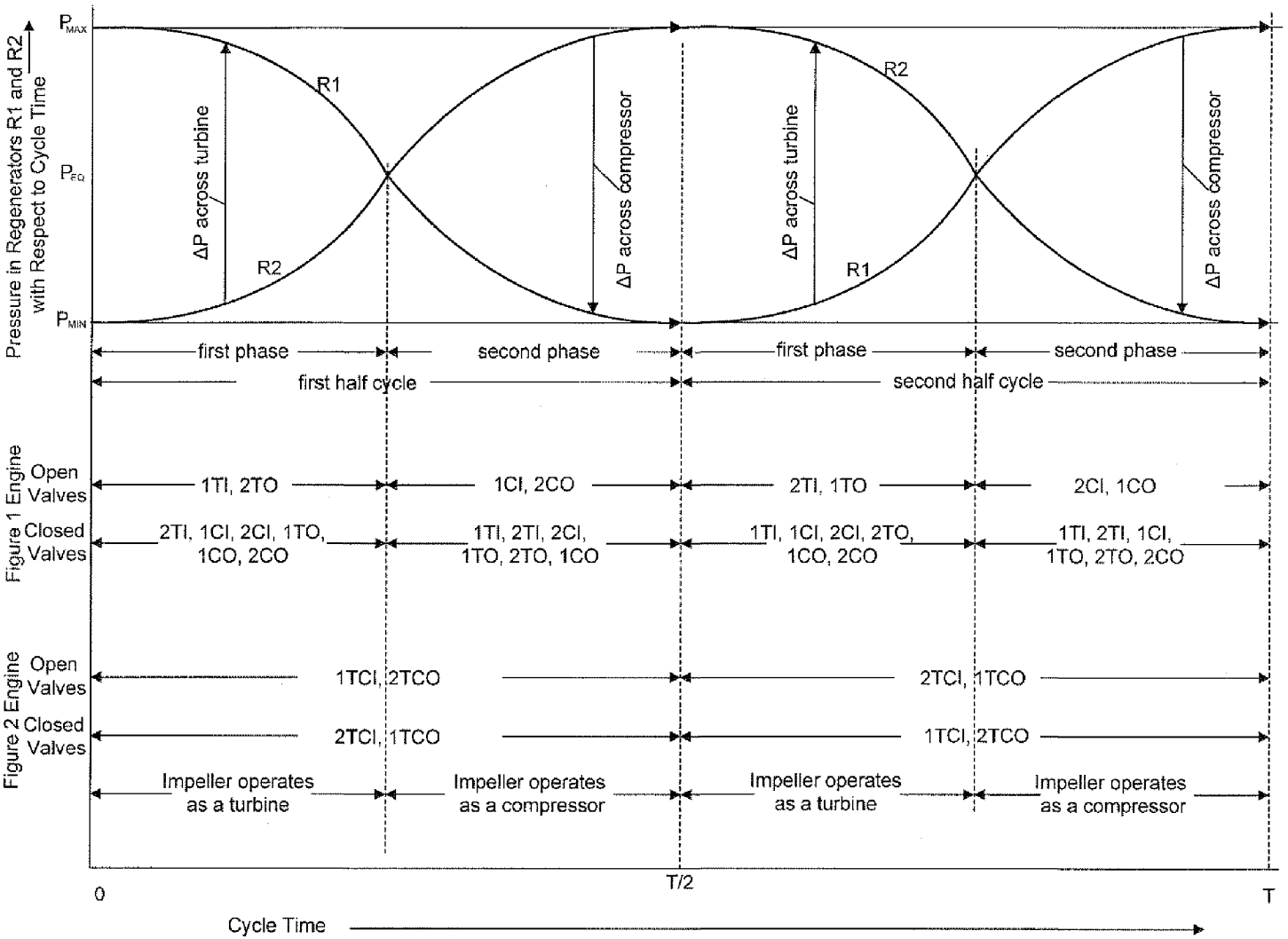
FIG. 6 shows the pressure variations in the heat regenerators of the paired heat regenerator engines in FIGS. 1, 2 and 3 over an engine operating cycle, and provides the valve operation schedule for the engines of FIGS. 1 and 2.

FIG. 6 shows the pressure variations in the heat regenerators of the paired heat regenerator engines in FIGS. 1, 2 and 3 with respect to cycle time, over one engine operating cycle, and provides the valve operation schedule for the engines of FIGS. 1 and 2. In FIG. 6, the start of an engine operating cycle is selected as the point in time when the pressure in heat regenerator R1 reaches its maximum value. In FIG. 6, each operating cycle is shown comprising two similar half cycles. In the first half cycle, working gas flows from heat regenerator R1, through the pressure variation means, into heat regenerator R2. In the second half cycle, heat regenerators R1 and R2 switch roles; with the working gas flowing from heat regenerator R2, through the pressure variation means, into heat regenerator R1. Additionally, FIG. 6 shows each half cycle of operation as comprising of two phases of operation. In the first phase of operation, working gas flows naturally from the sending heat regenerator (which is at a higher pressure) to the receiving heat regenerator (which is at a lower pressure), with the flowing working gas interacting with the pressure variation means to transfer to the pressure variation means the net positive readily usable work that is generated. In the second phase of operation of each half cycle, the pressure in the sending heat regenerator is lower than the pressure in the receiving heat regenerator, and the pressure variation means utilizes readily usable energy generated in the prior first phase operation to cause the flow of working gas from the sending heat regenerator to the receiving heat regenerator to occur.

Figure 7:
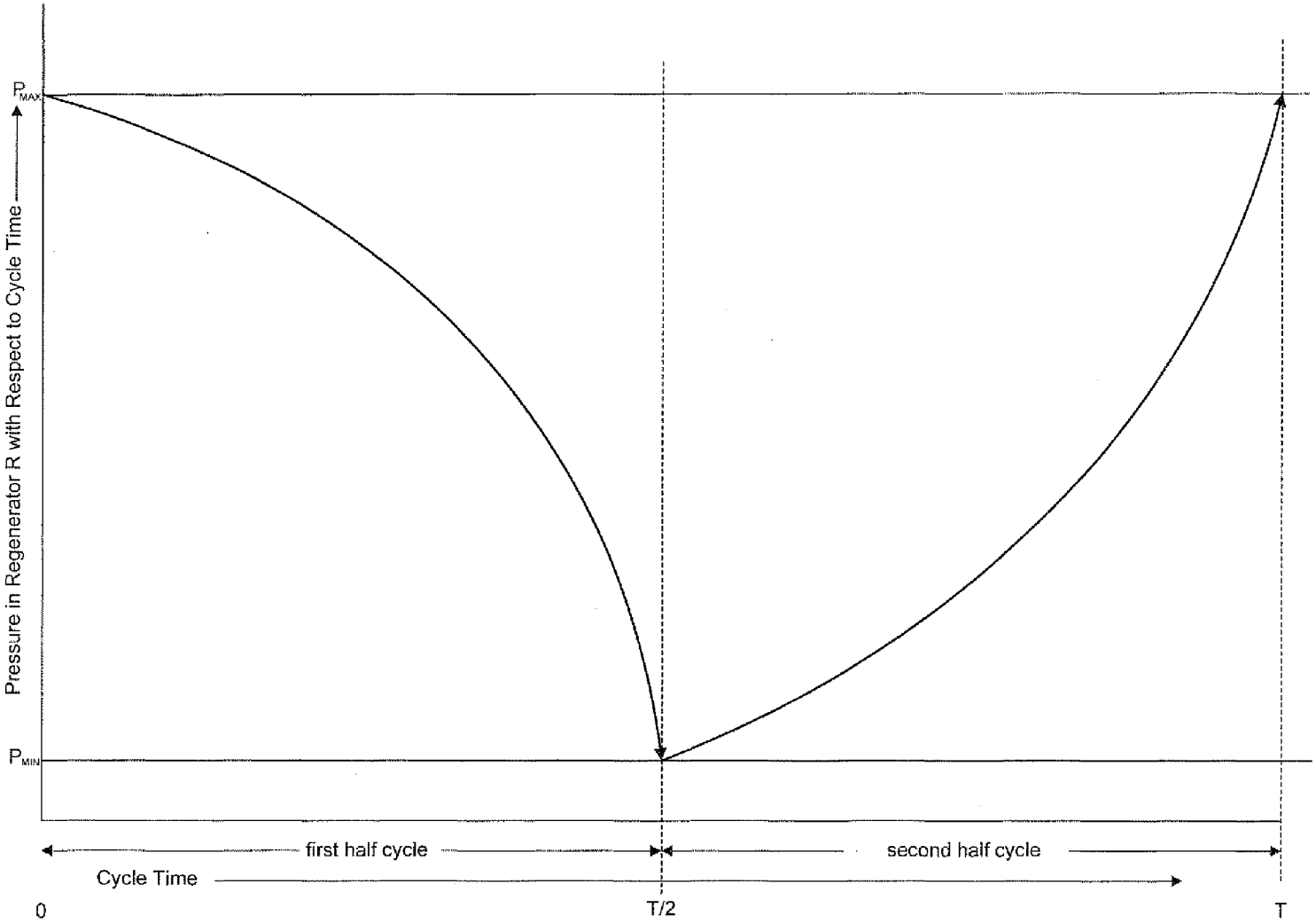
FIG. 7 shows the pressure variations in the heat regenerators of the engines in FIGS. 4 and 5 over an engine operating cycle.

FIG. 7 presents the pressure variations in the heat regenerators of the engines in FIGS. 4 and 5 with respect to cycle time. There is only one heat regenerator, and the engine operating cycle is divided into two half cycles, and there is only one phase of operation in each half cycle. In the first half cycle of operation, the heat regenerator pressure decreases from $P_{MAX}$ to $P_{MIN}$ as the pressure variation piston travels from its top dead center (TDC) position to its bottom dead center (BDC) position. The pressure trace will be asymptotic to the $P_{MAX}$ isobar at the start of the half cycle, and the heat regenerator pressure will initially decrease gradually and then fall rapidly towards $P_{MIN}$ at the end of the expansion step. In the second half cycle of operation, the heat regenerator pressure increases from $P_{MIN}$ to $P_{MAX}$ as the pressure variation piston travels from its BDC position to its TDC position. The pressure trace will be asymptotic to the $P_{MIN}$ isobar at the start of the half cycle, and the heat regenerator pressure will increase gradually at first and then rise rapidly towards the $P_{MAX}$ at the end of the compression step.

The expansion and compression steps in each heat regenerator are essentially the same irrespective of whether the design of the engine is of the first or second basic design type. Each expansion step starts with the working gas in that heat regenerator and its heat rejection means at the maximum pressure $P_{MAX}$ for that cycle. As the expansion step progresses, the working gas in the heat rejection means expands and flows from the heat rejection means, through its outlet end, into the second end of the heat regenerator; while simultaneously the working gas inside the heat regenerator also expands and plug flows from its first end towards its second end, from where some of the expanding working gas exits the heat regenerator. By plug flow is meant that each infinitessimally small slice of working gas inside the heat regenerator normal to the axis of working gas flow, remains adjacent to but distinct from its neighboring infinitessimally small axial slices. In other words, the working gas flows with no back mixing. Each elemental quantity of working gas in the heat regenerator continuously moves into a higher temperature region during the expansion step, and this physical movement of each elemental quantity of working gas into a higher temperature region, coupled with the natural tendency of the working gas to cool because of the expansion, results in the transfer of heat from the heat regenerator material into the expanding working gas. This continuous addition of heat to each infinitesimally small elemental quantity of the expanding working gas, causes the pressure of the expanding working gas to decrease at a slower rate than it would if heat were not continuously added to the expanding working gas. This is demonstrated graphically in FIG. 6, where the pressures in heat regenerators R1 and R2 of the FIGS. 1, 2 and 3 engines are plotted with respect to cycle time. The continuous addition of heat into the expanding working gas, is the reason why the shape of the pressure plot of the working gas in heat regenerator R1 for the first phase of the first half cycle, and heat regenerator R2 for the first phase of the second half cycle, is asymptotic to the $P_{MAX}$ isobar at the start of the expansion step, and gradually bends downwards until the pressure in the sending heat regenerator decreases to $P_{EQ}$ where the pressure in the sending and receiving heat regenerators equalize, instead of uniformly linearly descending from $P_{MAX}$ to $P_{EQ}$. Each elemental quantity of heat regenerator material (101) cools a little bit during the expansion step, because of the heat that it transfers to the expanding working gas flowing past it. This cooling that the heat regenerator material undergoes during each expansion step, readies it for receiving heat rejected by the working gas during the subsequent compression step. The working gas exiting the second end of the heat regenerator during the expansion step, would have exchanged heat with the heat regenerator material at the second end or hot end of the heat regenerator, prior to exiting the second end of the heat regenerator, and would be temperature equilibrated with the heat regenerator material at the hot end of the heat regenerator at a temperature near $T_{MAX}$. Therefore, the quantity of heat that needs to be, and can be, added to the working gas in the heat addition means during the expansion step, is limited to the heat that would be required to keep the expansion of this working gas during the expansion step isothermal at $T_{MAX}$. This is the basis for the heat duty of the heat addition means. At the start of a compression step in a heat regenerator, the working gas in that heat regenerator and its heat rejection means is at the minimum pressure $P_{MIN}$ for that cycle. As the compression step progresses, working gas is made to flow into the second end of the heat regenerator causing the working gas already present in the heat regenerator to compress and plug flow towards the first end of the heat regenerator, and into the heat rejection means attached to the first end of the heat regenerator, while simultaneousy the working gas in the heat rejection means is also undergoing compression. The working gas that flows into the heat rejection means (for the closed cycle engines in FIGS. 1, 2, and 4) during the compression step, is the same working gas that during the previous expansion step flowed from the heat rejection means into the heat regenerator. Each elemental quantity of working gas in the heat regenerator continuously moves into a lower temperature region of the heat regenerator as the compression step progresses, and this physical movement of each elemental quantity of working gas into a cooler region, coupled with the tendency for the working gas to heat up due to the compression effect, results in the transfer of heat from the compressing working gas into heat regenerator material. This continuous rejection of heat from each infinitely small elemental quantity of the compressing working gas, causes the pressure of the compressing working gas to increase at a slower rate, than it would if heat were not continuously rejected from the compressing working gas. This is demonstrated in FIG. 6, where the pressure plot of the working gas in heat regenerator R2 for the first phase of the first half cycle, and heat regenerator R1 for the first phase of the second half cycle is asymptotic to the $P_{MIN}$ isobar at the start of the half cycle, and gradually bends upwards until their pressure increase to $P_{EQ}$, where the pressures in the sending and receiving heat regenerators equalize, instead of uniformly linearly ascending from $P_{MIN}$ to $P_{EQ}$. Each elemental quantity of heat regenerator material (101) increases in temperature during the compression step because of the heat that it receives from the compressing working gas. This increase in temperature that the heat regenerator material experiences during each compresssion step readies it for adding heat to the working gas during the subsequent expansion step. The working gas exiting the first end of the heat regenerator and entering the heat rejection means during the compression step, would have exchanged heat with and would be temperature equilibrated with the heat regenerator material at the first end (or cold end) of the heat regenerator. Therefore the quantity of heat that can be (and needs to be) rejected from this working gas that exits the first end of the heat regenerator during the compression step in the heat rejection means is limited to that required to keep the compression of this working gas in the heat rejection means isothermal at $T_{MIN}$. This establishes the basis for the heat duty required in the heat rejection means. During steady state operation, a gradation in temperature is established in the heat regenerator from near $T_{MAX}$ at the second end or the hot end to near $T_{MIN}$ at the first end or the cold end. The temperature gradient is set up because of the addition of heat to the working gas by the heat addition means (7) (at a temperature $T_{MAX}$) and rejection of heat (at a temperature $T_{MIN}$) to the heat sink in heat rejection means (50).

The engines of the first design type are described in FIGS. 1, 2 and 3. In the case of FIG. 1, two separate impellers T and C, are chosen to interact with the expanding and compressing working gas respectively. T represents the turbine and is used to convert the flow of working gas flowing naturally from a higher pressure location to a lower pressure location into mechanical shaft work. C represents the compressor which uses mechanical shaft work to cause the flow of working gas from a lower pressure location to a higher pressure location to occur. In the case of the FIG. 2 engine, a single impeller TC serves as both the turbine and the compressor. In the case of the FIG. 3 engine, the magnetohydrodynamic flow channel interacts with the expanding and compressing working gas. In the engines of the first basic design type, when one heat regenerator is at the maximum pressure $P_{MAX}$ for that cycle, its pair heat regenerator will be at the minimum pressure $P_{MIN}$, and working gas will flow from the second end of the heat regenerator at pressure $P_{MAX}$ through the heat addition and pressure variation means into the second end of the pair heat regenerator at pressure $P_{MIN}$, since flow naturally occurs from a higher pressure region to a region where the pressure is lower. When working gas flows out of a heat regenerator at pressure $P_{MAX}$, the working gas in the sending heat regenerator and its heat rejection means will continuously expand and decrease in pressure from $P_{MAX}$, while simultaneously the working gas in the receiving heat regenerator and its heat rejection means will continuously compress and increase in pressure from $P_{MIN}$. The natural flow of the working gas from the sending heat regenerator at a higher pressure through the heat addition and pressure variation means into the receiving heat regenerator at a lower pressure, constitutes the first of two phases of each half cycle. The first phase of each half cycle terminates when the decreasing pressure in the sending heat regenerator and the increasing pressure in the receiving heat regenerator equalize at pressure $P_{EQ}$. In the case of the FIG. 1 engine, during this first phase of each half cycle, the natural flow of working gas across turbine T will result in the rotation of turbine T generating readily usable energy in the form of mechanical shaft work which will be stored in flywheel (11) installed on shaft (15), which rotates when turbine (T) rotates. In the case of the FIG. 2 engine, during this first phase of each half cycle, the natural flow of working gas across turbocompressor impeller TC will result in the rotation of turbocompressor impeller TC acting as a turbine, generating readily usable energy in the form of mechanical shaft work which will be stored in flywheel (11) installed on shaft (15), which rotates when turbocompressor impeller TC rotates. In the case of the FIG. 3 engine, during the first phase of each half cycle, the natural flow of working gas in the magnetohydrodynamic channel 171, will result in the generation of readily usable energy in the form of electrical energy which will be generated in and transmitted by electrical circuitry 172 to electrical circuitry 173, and stored in or distributed from electrical circuitry 173 as needed. The readily usable energy generated in the first phase of each half cycle of operation of the FIGS. 1, 2, and 3 engines will be used to keep the engine running, or cause the engine to accelerate, and any excess readily usable energy can be transferred to the load. A portion of the readily usable energy will be transferred back to compressor C in the case of the FIG. 1 engine, turbocompressor TC acting as a compressor in the case of the FIG. 2 engine, and electrical circuitry 172 in the case of the FIG. 3 engine, to cause the flow of working gas from the sending heat regenerator to the receiving heat regenerator to continue, to accomplish the second phase of each half cycle. During the second phase of each half cycle, stored energy in the pressure variation means has to be used to cause the flow of the working gas from the sending heat regenerator to the receiving heat regenerator to continue, because the pressure of the working gas in the sending heat regenerator is less than the pressure of the working gas in the receiving heat regenerator. The continued flow of working gas from the sending heat regenerator to the receing heat regenerator, causes the working gas in the sending heat regenerator and its heat rejection means to further expand and decrease in pressure from $P_{EQ}$ to $P_{MIN}$, while simultaneously, the working gas in the receiving heat regenerator and its heat rejection means further compresses and increases in pressure from $P_{EQ}$ to $P_{MAX}$, at which point the half cycle terminates. The valves in FIGS. 1 and 2, and the valve timing as to when they are open and when they are closed (described earlier and also shown graphically in FIG. 6), are so chosen as to permit the above described flows between the heat regenerators, over an entire cycle of operation. As each operating phase of each half cycle terminates, the valves in the case of the FIG. 1 engine, switch positions to permit the flow to swich from the turbine to the compressor or vice versa as required. The valves in the FIG. 2 engine, swich positions at the completion of every half cycle. In the case of the FIG. 3 engine, no valves are needed as the working gas flows in both directions of flow channel 171 and the electrical circuitry 173 deals with the change in polarity of the electromotive force (EMF) generated in electrical circuitry 172. Also, in FIG. 3, appropriately timed valve controller (not shown) operated valves 124 and 125 are provided to supply fuel and air respectively to the fossil fuel combustor 118, to add the hot products of combustion into the expanding working gas exiting the second end of the sending heat regenerator. Valve controller (not shown) operated bleed valves 116 are provided for bleeding excess working gas from the heat rejection means of the receiving heat regenerator towards the end of the compression step in the receiving heat regenerator. The bleed valves 116 may not be required if the energy recovery device can be designed with the correct pressure drop so that the appropriate amount of working gas is bled per cycle. With the bleed valves 116 not provided, the majority of the excess working gas will automatically be bled towards the end of the compression step when the pressure forcing the excess working gas into the energy recovery device is the highest. The energy recovery device uses the energy recovered from the bled gas to take in oxygen bearing fresh atmospheric air 112, and compress it for use as combustion air 119 in the fossil fuel burners 118 that supply hot products of combustion that make up the heat addition means in the FIG. 3 engine. In FIG. 6, the time duration for the first phase of each half cycle is shown as being equal to the time duration of the second phase of the half cycle for the sake of simplicity. The relative time durations will depend on the how well the turbine and compressors are matched. Also, in FIG. 6, $P_{EQ}$ is shown as being equal to the average of the maximum and minimum pressures. This does not have to be the case during every cycle, and $P_{EQ}$ could be higher or lower than the average of the maximum and minimum pressures. It just depends upon how well the turbine operation matches the compressor operation. The second half cycle is identical to the first half cycle, except that the sending heat regenerator in the first half cycle becomes the receiving heat regenerator in the second half cycle, and the receiving heat regenerator in the first half cycle becomes the sending heat regenerator in the second half cycle. By observing the difference in pressure between the sending heat regenerator and the receiving heat regenerator at any given point in the cycle, one can determine the pressure differential driving turbine (T) or the pressure differential created by compressor (C). In the case of the heat regenerator pressures in FIG. 6, the pressure traces are labeled R1 for heat regenerator R1, and R2 for heat regenerator R2, and R1 is depicted as the sending heat regenerator and R2 as the receiving heat regenerator, for the first half cycle. As can be observed during the first phase of each half cycle in FIG. 6, the differential pressure driving turbine T in FIG. 1, impeller TC acting as a turbine in FIG. 2, and the pressure differential forcing the working gas to flow in magnetohydrodynamic flow channel 171 in FIG. 3, varies from a maximum pressure differential of ($P_{MAX}$–$P_{MIN}$) at the start of the first phase of the half cycle, to zero at the end of the first phase. Therefore, turbine T in FIG. 1, and impeller TC acting as a turbine in FIG. 2, are significantly different from the turbine used in steam and gas turbine engine applications, where the pressure differential across the turbine remains constant. The same can be said of compressor C in FIG. 1, and impeller TC acting as a compressor in FIG. 2, where the differential pressure across the compressor is zero at the start of the second phase of each half cycle and increases to a maximum of –($P_{MAX}$–$P_{MIN}$) at the end of the second phase of each half cycle. Also, having two separate impellers, one serving as a turbine and the other as a compressor, as in the FIG. 1 engine, permits the use of two pairs of heat regenerators, or a total of four heat regenerators in the same engine. This is because when the turbine T acts upon one of the pairs of heat regenerators, the compressor C can act upon the other pair, and vice versa.

The working gas in a sending heat regenerator expands and produces readily usable integral(pdv) work or mechanical shaft work. The pressure variation means interacts with the flowing working gas to absorb and store this readily usable work. The working gas in a receiving heat regenerator is compressed and readily usable energy has to be used to make this compression step occur. During the first phase of a half cycle, more readily usable energy will be produced by the expanding working gas in the sending heat regenerator than is used up to compress the working gas in the receiving heat regenerator. Hence, during the first phase of a half cycle, the pressure variation means will absorb the net positive readily usable energy produced and transmit it to the flywheel in the case of the FIGS. 1 and 2 engines or the electrical storage circuitry 173 of the FIG. 3 engine. A portion of this readily usable energy will be transmitted back to the pressure variation means to make happen the continued flow of working gas from the sending heat regenerator to the receiving heat regenerator during the second phase of the half cycle. By mathematical modeling, it can be shown that more net positive readily usable energy is generated during the first phase of a half cycle, than is used to accomplish the second phase of the half cycle. Mathematical modeling would consist of developing pressure-volume (P-V) traces that will be performed by elemental quantities of working gas at the same temperature and pressure. The elemental quantities of working gas can be found in elemental slices of working gas of thickness "dx" normal to the axis of working gas flow at a distance "x" from the cold end of the heat regenerator. In the case of the paired heat regenerator engines, two separate ranges for "x" need to be considered. For values of "x" from zero up to a certain value, the P-V traces will consist of expansion from pressure $P_{MAX}$ to $P_{MIN}$. For elemental quantities of working gas with values of "x" greater than this certain value, the P-V traces will start on the $P_{MAX}$ isobar but the elemental quantity of working gas will cross over the pressure variation means before expanding all the way down to a pressure of $P_{MIN}$. Therefore, for the elemental quantities of working gas having values of "x" greater than this certain value, the expansion trace will be performed in the sending heat regenerator but the compression trace will be executed in the receiving heat regenerator. Mathematical modeling will show that the elemental quantities of working gas, whether they have values of "x" smaller or larger than the certain value, will traverse their P-V traces in a clock wise direction, showing that net positive readily usable energy is being generated by each elemental quantity of working gas. Finally, one may deduce that the proposed engines will not only work, but that they will work with maximized thermal efficiency thermodynamically possible. This is deduced by noting that any heat that is supplied to the working gas from an external heat source, is supplied at the maximum temperature; and any heat that is rejected by the working gas to an external heat sink is rejected at the minimum temperature possible, given the constraints of the heat source and heat sink temperatures.

The expansion step in engines of the second basic design type occurs as the pressure variation piston (8) travels from its top dead center (TDC) position to its bottom dead center (BDC) position, the working gas in the heat regenerator expands and plug flows towards the second end of the heat regenerator, and flows out of the second end of the heat regenerator (R) into the volume swept by the pressure variation piston. The pressure of the working gas decreases from its maximum value in that cycle to its minimum value during the expansion step. The compression step occurs as the pressure variation piston (8) travels from BDC to TDC, the working gas flows from the volume swept by the pressure variation piston (8) back into the second end of heat regenerator (R) causing the working gas in heat regenerator R and its heat rejection means to compress, while simultaneously plug flowing towards the cold end of the heat regenerator. The pressure of the working gas increases from its minimum value in that cycle to its maximum value during the compression step. During the expansion step, heat energy is added to the working gas exiting the second end of the heat regenerator, the expansion of the working gas results in the generation of integral (pdv) or readily usable energy, and the interaction of the expanding working gas with the pressure variation piston transfers the readily usable energy to the pressure variation piston from where it is transmitted through the crank to the rotating crank shaft and the flywheel. During the compression step, some of the readily usable energy is transmitted back from the flywheel, through the crank, to the pressure variation piston, to cause the flow of working gas from the volume swept by the pressure variation piston back into the heat regenerator, thereby resulting in the compression of the working gas in the heat regenerator and its heat rejection means. FIG. 7 shows the variation of the working gas pressure in heat regenerator R in the FIGS. 4 and 5 engines with respect to cycle time. The engine cycle is shown as starting with the pressure variation piston at its top dead center (TDC) position and the pressure in heat regenerator R at P. Working gas will flow out of the second end of the heat regenerator through the heat addition means (in the case of the FIG. 4 engine) into the volume swept by the pressure variation piston. The working gas in the heat regenerator and the heat rejection means expands, as the working gas flows out of the second end of the heat regenerator into the volume swept by the piston, and the pressure of the working gas decreases continuously, reaching its minimum pressure when the pressure variation piston raches its bottom dead center (BDC) position. The pressure variation piston, then causes the working gas to flow back into the heat regenerator as it travels from its BDC positon to its TDC position, compressing the working gas and causing the working gas pressure to continuously increase until the pressure reaches $P_{MAX}$, as the the pressure variation piston reaches its TDC position to complete one cycle. FIG. 7 shows that in the first half cycle, the pressure in heat regenerator R remains higher than it would be if heat were not constantly added into the working gas, and this increased pressure serves to drive down the pressure variation piston. The driving down of the pressure variation piston results in the turning of the crank shaft and the imparting of readily usable energy (generated during and by the expansion of the working gas) in the form of integral(pdv) work or mechanical shaft work to the flywheel on the crank shaft. This readily usable energy is used to keep the engine running, or to cause the engine to accelerate, and any excess readily usable energy can be supplied to satisfy the engine load. A portion of the readily usable energy in the flywheel is transferred back through the crank to the pressure variation piston, and is used by the pressure variation piston to push the working gas from the volume swept by the pressure variation piston back into the second end of the heat regenerator during the second half cycle. Also, FIG. 7 shows that in the second half cycle, the pressure in heat regenerator R remains lower than it would be if heat were not constantly being rejected by the compressing working gas and this reduced pressure helps the pressure variation piston push the working gas into the heat regenerator from the volume swept by the pressure variation piston. In FIG. 4 a hermetically sealed system is shown. The engine is started by cranking using a stored energy source after the heat addition means are turned on. Cranking will need to be applied until the heat regenerator develops the needed temperature gradient from the hot end to the cold end. The energy that is produced is supplied to the load in the form of electrical energy transmitted through wires that lead out of the crank case through insulating plugs (not shown). The working gas once charged to the system remains in the system and recharging of working gas will be needed to make up working gas that may diffuse of of the system over time, or if the system is depressurized for maintenance. In FIG. 5 an internal combustion engine is provided as the heat addition means. The internal combustion engine adds hot products of combustion into the volume swept by the pressure variation piston during the expansion step. The hot products of combustion add heat into the expanding working gas and become working gas. Excess working gas is bled from the heat rejection means towards the end of the compression step. In FIG. 5, a piston position controlled bleed valve 116 is shown. The piston position controlled bleed valve may not be required if the energy recovery device can be designed to bleed the required quantity of excess working gas with a pressure drop that matches the supercharged pressure of the working gas. The majority of the excess working gas will automatically be bled towards the end of the compression step when the pressure forcing the excess working gas into the energy recovery device is the highest. The energy recovery device uses the energy present in the bled gas to take in oxygen bearing atmosheric air and compress it for use as combustion air in the two stroke internal combustion engine that supplies hot products of combustion that make up the heat addition and working gas in the hot gas engine. Mathemathical modeling of the working gas in engines of the second basic design type is similar to the mathemathical modeling described above for the paired heat regenerator engines. The mathemathical modeling of the engines of the second basic design type is simpler because the P-V traces for elemental quantities of working gas are similar for all values of "x". The FIG. 5 engine is started by cranking and starting the internal combustion engine. Initially no load is applied to the FIG. 5 engine as it would be running solely on the power devoped by the internal combustion engine. However, very quickly, the pressure of the working gas will rise and the temperature gradients will get established in the heat regenerator, and the hot gas engine in FIG. 5 engine will take over and operate to produce the bulk of the power output.

The FIGS. 1, 2, and 3 paired heat regenerator engines of the first design type can be started by pressurizing each regenerator of a pair of heat regenerators alternately with compressed air applied at the bleed and fill valves 170, after turning on or applying the heat source in the heat addition means. The alternate pulsing will establish the required pressures of working gas, and establish the required temperature gradients across the heat regenerators from the first end or the cold end to the second end or the hot end, and the engine will be able to operate on its own.

What is claimed is:

1. A heat regenerator hot gas engine, comprising:

a working gas;

a heat regenerator, wherein the heat regenerator comprises a heat regenerator first end, and a heat regenerator second end;

a cooler fluid seal connected to the heat regenerator first end, wherein the cooler comprises a cooler inlet and a cooler outlet;

a heat sink positioned outside the cooler, wherein the heat sink is configured to receive heat coming from the cooler;

a pressure variation means, and an external heat source being fluid seal connected to the heat regenerator second end;

wherein a portion of said working gas occupying the inside of the cooler and a portion of said working gas occupying the inside of the heat regenerator are alternately expanded and compressed;

wherein a portion of the portion of said working gas occupying the inside of the cooler exiting the cooler through the cooler outlet, and a portion of the portion of said working gas occupying the inside of the heat regenerator exiting the heat regenerator through the heat regenerator second end, while the portion of said working gas occupying the inside of the cooler and the portion of said working gas occupying the inside of the heat regenerator expand;

wherein the portion of said working gas in the heat regenerator is added heat by the heat regenerator, and the portion of said working gas exiting the heat regenerator through the heat regenerator second end is added heat with/by said external heat source;

wherein the portion of said working gas in the cooler and the portion of said working gas in the heat regenerator expand to produce usable work;

wherein the pressure variation means is configured to interact with the portion of said working gas exiting the heat regenerator second end, while the portion of said working gas in the cooler and the portion of said working gas in the heat regenerator expand, thereby the pressure variation means receives readily usable work produced during the expansion of the portion of said working gas in the cooler and the portion of said working gas in the heat regenerator;

wherein the pressure variation means is further configured to utilize a portion of the readily usable work, to force the working gas flowing out of the heat regenerator second end during the expansion, to flow back into the heat regenerator through the heat regenerator second end, thereby effecting the compression of the portion of said working gas in the heat regenerator and the portion of said working gas in the cooler;

wherein the portion of said working gas exiting the cooler through the cooler outlet during the expansion, flows back into the cooler through the cooler inlet, while the portion of said working gas in the heat regenerator and the portion of said working gas in the cooler are compressed, and wherein the heat regenerator absorbs heat from the compressing working gas in the heat regenerator, and the heat sink absorbs heat coming from the cooler during the compression of the portion of said working gas in the heat regenerator and the portion of said working gas in the cooler.

2. A heat regenerator hot gas engine according to claim 1 further comprising:

a first hot gas engine; and a second hot gas engine;

wherein the first hot gas engine is identical to the second hot gas engine;

wherein the pressure variation means is shared by the first hot gas engine and the second hot gas engine;

a fluid sealed flow channel connects the heat regenerator second end of the heat regenerator of the first hot gas engine to the heat regenerator second end of the heat regenerator of the second hot gas engine;

wherein the pressure variation means is positioned in the fluid sealed flow channel connecting the heat regenerator second end of the heat regenerator of the first hot gas engine with the heat regenerator second end of the heat regenerator of the second hot gas engine;

a portion of said working gas exiting the heat regenerator of the first hot gas engine through the heat regenerator second end of the heat regenerator of the first hot gas engine, while the portion of said working gas in the cooler and the portion of said working gas in the heat regenerator of the first hot gas engine expand, thereby decreasing pressure;

wherein the portion of said working gas exiting the heat regenerator second end of the heat regenerator of the first hot gas engine flows into the heat regenerator of the second hot gas engine through the heat regenerator second end of the heat regenerator of the second hot gas engine, thereby causing the portion of said working gas in the cooler and the portion of said working gas in the heat regenerator of the second hot gas engine to compress, thereby increasing pressure;

a natural flow of working gas from the heat regenerator second end of the heat regenerator of the first hot gas engine to the heat regenerator second end of the heat regenerator of the second hot gas engine, wherein the pressure of the portion of said working gas in the cooler and the portion of said working gas in the heat regenerator of the first hot gas engine is higher than the pressure of the portion of said working gas in the cooler and the portion of said working gas in the heat regenerator of the second hot gas engine;

wherein the natural flow of portion of said working gas from the heat regenerator second end of the heat regenerator of the first hot gas engine to the heat regenerator second end of the heat regenerator of the second hot gas engine produces usable work;

wherein an interaction between the naturally flowing portion of said working gas and the pressure variation means, enables the pressure variation means to receive the usable work produced during the natural flow of portion of said working gas;

wherein a portion of the usable work is utilized by the pressure variation means, and the pressure variation means effects the continued flow of portion of said working gas from the heat regenerator second end of the heat regenerator of the first hot gas engine to the heat regenerator second end of the heat regenerator of the second hot gas engine, wherein the pressure of portion of said working gas in the first hot gas engine is lower than the pressure of portion of said working gas in the second hot gas engine;

a working gas flow switching means that causes, the portion of said working gas to flow from the pressure variation means interacting with the natural flow of portion of said working gas to, wherein the pressure variation means is configured to effect the continued flow of portion of said working gas from the first hot gas engine to the second hot gas engine;

a first hot gas engine and second hot gas engine switching means;

wherein the first hot gas engine and second hot gas engine switching means causes, the first hot gas engine to become the second hot gas engine, and the second hot gas engine becomes the first hot gas engine.

3. A heat regenerator hot gas engine according to claim 2, the pressure variation means comprising:

a turbine, wherein the turbine interacts with the naturally flowing portion of said working gas when the pressure of the portion of said working gas in the first hot gas engine is higher than the pressure of the portion of said working gas in the second hot gas engine;

a compressor, wherein the compressor effects the continued flow of the working gas from the first hot gas engine to the second hot gas engine when the pressure of the portion of said working gas in the first hot gas engine is lower than the pressure of the portion of said working gas in the second hot gas engine;

multiple opening and closing valves, wherein the multiple opening and closing valves serve as the switching means between the first hot gas engine and the second hot gas engine; and wherein the multiple opening and closing valves serve as the switching means of portion of said working gas flow.

4. A heat regenerator hot gas engine according to claim 2, comprising:

a single impeller turbo-compressor, wherein the single impeller interacts with the naturally flowing portion of said working gas when the pressure of the portion of said working gas in the first hot gas engine is higher than the pressure of the portion of said working gas in the second hot gas engine; and the single impeller is additionally configured to effect the continued flow of portion of said working gas from the first hot gas engine to the second hot gas engine when the pressure of the portion of said working gas in the first hot gas engine is lower than the pressure of the portion of said working gas in the second hot gas engine; and multiple opening and closing valves, wherein the multiple opening and closing valves serve as the switching means between the first hot gas engine and the second hot gas engine.

5. A heat regenerator hot gas engine according to claim 2, comprising:

a portion of flue gas from a fossil fuel burner to which seed material is added to create electrical properties in the flue gas, wherein the portion of said flue gas from the fossil fuel burner serves as the engine working gas;

a portion of fresh hot flue gas injected into the working gas exiting the heat regenerator second end of the heat regenerator of the first hot gas engine, wherein the portion of fresh hot flue gas serves as the external heat source being and becomes additional working gas;

a magneto-hydrodynamic generator flow channel, wherein the magneto-hydrodynamic generator flow channel serves to connect the heat regenerator second end of the heat regenerator of the first hot gas engine with the heat regenerator second end of the heat regenerator of the second hot gas engine;

a magneto-hydrodynamic generator flow channel electrical circuit, wherein the magneto-hydrodynamic generator flow channel electrical circuit serves as the pressure variation means, and wherein the magneto-hydrodynamic flow channel electrical circuit additionally serves as the switching means between the first hot gas engine and the second hot gas engine;

a flow controlled bleed path provided at the cooler of each of the first hot gas engine and the second hot gas engine, wherein, a flow controlled bleed path provided at the cooler of each of the first hot gas engine and the second hot gas engine serves as the flow controlled bleed path for excess portion of said working gas.

6. A heat regenerator hot gas engine according to claim 1, comprising:

a portion of exhaust gas from an internal combustion engine;

wherein the portion of exhaust gas from the internal combustion engine serves as the working gas for the hot gas engine;

a piston reciprocating in a cylinder, wherein the piston reciprocating in a cylinder serves as the pressure variation means, the portion of hot exhaust gas from an internal combustion engine injected into portion of said working gas exiting the heat regenerator second end, wherein the portion of said working gas expands in the cooler and the heat regenerator, wherein portion of said hot exhaust gas serves as the external heat source, and serves as a portion of working gas;

a flow controlled bleed path, wherein, the flow controlled bleed path provided at the cooler serves as the flow controlled bleed path for said portion of excess working gas.

* * * * *